US009770902B2

(12) United States Patent
Yamashita

(10) Patent No.: US 9,770,902 B2
(45) Date of Patent: Sep. 26, 2017

(54) HEAD DRIVE IC AND LIQUID DISCHARGE APPARATUS

(71) Applicant: BROTHER KOGYO KABUSHIKI KAISHA, Nagoya-shi, Aichi-ken (JP)

(72) Inventor: Toru Yamashita, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 15/281,486

(22) Filed: Sep. 30, 2016

(65) Prior Publication Data

US 2017/0087827 A1 Mar. 30, 2017

(30) Foreign Application Priority Data

Sep. 30, 2015 (JP) ..... 2015-194273

(51) Int. Cl.
*B41J 2/045* (2006.01)
*B41J 3/54* (2006.01)

(52) U.S. Cl.
CPC ..... *B41J 2/04541* (2013.01); *B41J 2/0455* (2013.01); *B41J 2/04518* (2013.01); *B41J 2/04546* (2013.01); *B41J 2/04551* (2013.01); *B41J 2/04581* (2013.01); *B41J 2/04588* (2013.01); *B41J 3/546* (2013.01)

(58) Field of Classification Search
CPC .. B41J 2/04541; B41J 2/04551; B41J 2/0455; B41J 3/546; B41J 2/04546; B41J 2/04518; B41J 2/0481; B41J 2/04588
See application file for complete search history.

(56) References Cited

U.S. PATENT DOCUMENTS 4,803,500 A * 2/1989 Milbrandt ..... B41J 25/34 347/43
6,108,101 A * 8/2000 Cheng ..... B41J 2/17546 347/13

(Continued)

FOREIGN PATENT DOCUMENTS

JP 2002-210969 A 7/2002
JP 2003-326726 A 11/2003

(Continued)

OTHER PUBLICATIONS

Japanese Office Action dated Mar. 29, 2011 issued in JP 2008-301868.

(Continued)

*Primary Examiner* — Julian Huffman
(74) *Attorney, Agent, or Firm* — Scully, Scott, Murphy & Presser, PC

(57) ABSTRACT

A head drive IC includes: a first waveform input part to which a first waveform signal being used for generation of drive signals is inputted; a second waveform input part to which a second waveform signal different from the first waveform signal and being used for generation of the drive signals is inputted; a switching signal input part to which a switching signal is inputted; and an input switching circuit which performs switching between a state in which both of the input of the first waveform signal and the input of the second waveform signal are allowed, and a state in which the input of the first waveform signal is allowed and the input of the second waveform signal is blocked.

15 Claims, 10 Drawing Sheets

(56) References Cited

U.S. PATENT DOCUMENTS

| | | | | |
|---|---|---|---|---|
| 6,702,413 | B2 | 3/2004 | Takabayashi et al. | |
| 7,234,788 | B2 * | 6/2007 | Gardner | B41J 2/04508 347/10 |
| 8,348,366 | B2 | 1/2013 | Yamashita | |
| 2010/0128075 | A1 | 5/2010 | Yamashita | |
| 2011/0210999 | A1 * | 9/2011 | Higashikawa | B41J 2/04541 347/9 |
| 2015/0054868 | A1 * | 2/2015 | Kashimura | B41J 2/04541 347/9 |

FOREIGN PATENT DOCUMENTS

| | | | |
|---|---|---|---|
| JP | 2004-154986 | A | 6/2004 |
| JP | 2005-131875 | A | 5/2005 |
| JP | 2007-118512 | A | 5/2007 |
| JP | 2007-210210 | A | 8/2007 |
| JP | 4888475 | B2 | 2/2012 |
| JP | 2013-094991 | A | 5/2013 |

OTHER PUBLICATIONS

Japanese Office Action dated Aug. 3, 2010 issued in JP 2008-301868.

* cited by examiner

HEAD DRIVE IC AND LIQUID DISCHARGE APPARATUS

CROSS REFERENCE TO RELATED APPLICATION

The present application claims priority from Japanese Patent Application No. 2015-194273 filed on Sep. 30, 2015, the disclosure of which is incorporated herein by reference in its entirety.

BACKGROUND OF THE INVENTION

Field of the Invention

The present invention relates to a head drive IC driving a liquid discharge head which discharges liquid from nozzles and a liquid discharge apparatus including the head drive IC.

Description of the Related Art

As a head drive IC driving a liquid discharge head, Japanese Patent Application laid-open No. 2013-94991 describes a head driver IC driving a recording head of an image recording apparatus. In the image recording apparatus described in Japanese Patent Application laid-open No. 2013-94991, the recording head is configured to discharge inks of four colors (black, yellow, cyan, and magenta). An ASIC of a main board generates a waveform data corresponding to a dot size of the black ink and a waveform data corresponding to a dot size of the color inks (the inks except for the black ink) to output them to the head driver IC.

As another head drive IC driving a liquid discharge head, Japanese Patent Application laid-open No. 2007-210210 describes a head controller controlling a head unit of a printer. In the printer described in Japanese Patent Application laid-open No. 2007-210210, the head unit discharges inks of four colors (black, yellow, cyan, and magenta). A controller board includes four drive signal generation circuits corresponding to the inks of four colors. The four drive signal generation circuits generate, based on respective waveform data stored in a storage part, drive signals for the black ink, the yellow ink, the cyan ink, and the magenta ink (COM1 to COM4), to output them to the head controller.

SUMMARY

In general, the head drive IC, as described in Japanese Patent Application laid-open No. 2013-94991, which is used in the printer generating the waveform common to the yellow, cyan, and magenta inks (the waveform corresponding to the color inks) is designed separately from the head drive IC, as described in Japanese Patent Application laid-open No. 2007-210210, which is used in the printer generating mutually different waveforms for the yellow, cyan, magenta inks. Designing the head drive ICs used in these two types of printers separately leads to the increase in man-hours for development and development costs.

An object of the present teaching is to provide a head drive IC capable of preventing the increase in man-hours for development and development costs and a liquid discharge apparatus including the head drive IC.

According to an aspect of the present teaching, there is provided a head drive IC, of a liquid discharge head including nozzles and drive elements configured to apply discharge energy to liquid in the nozzles, configured to drive the drive elements, the head drive IC comprising:

a first waveform input part to which a first waveform signal is inputted, the first waveform signal being used for generation of drive signals driving the drive elements;

a second waveform input part to which a second waveform signal is inputted, the second waveform signal being different from the first waveform signal and used for generation of the drive signals;

a switching signal input part to which a switching signal is inputted; and an input switching circuit configured to perform switching between a state in which both of the input of the first waveform signal in the first waveform input part and the input of the second waveform signal in the second waveform input part are allowed, and a state in which the input of the first waveform signal in the first waveform input part is allowed and the input of the second waveform signal in the second waveform input part is blocked, according to an input state of the switching signal in the switching signal input part.

According to the aspect of the present teaching, when both of the input of the first waveform signal in the first waveform signal input part and the input of the second waveform signal in the second waveform input part are allowed, the head drive IC can be used as a head drive IC which drives the drive elements of the liquid discharge head by using the drive signal generated from the first waveform signal and the drive signal generated from the second waveform signal. When the input of the first waveform signal in the first waveform signal input part is allowed and the input of the second waveform signal in the second waveform signal input part is blocked, the head drive IC can be used as a head drive IC which drives the drive elements of the liquid discharge head by using the drive signal generated from the first waveform signal. As described above, the head drive IC of the present teaching can function as two types of head drive ICs for the liquid discharge head those of which drive the drive elements, thus preventing the increase in man-hours for development and development costs for the head drive IC.

DESCRIPTION OF THE EMBODIMENTS

Hereinafter, an explanation will be made about preferred embodiments of the present teaching.

<Overall Structure of Printer>

Figure 1:
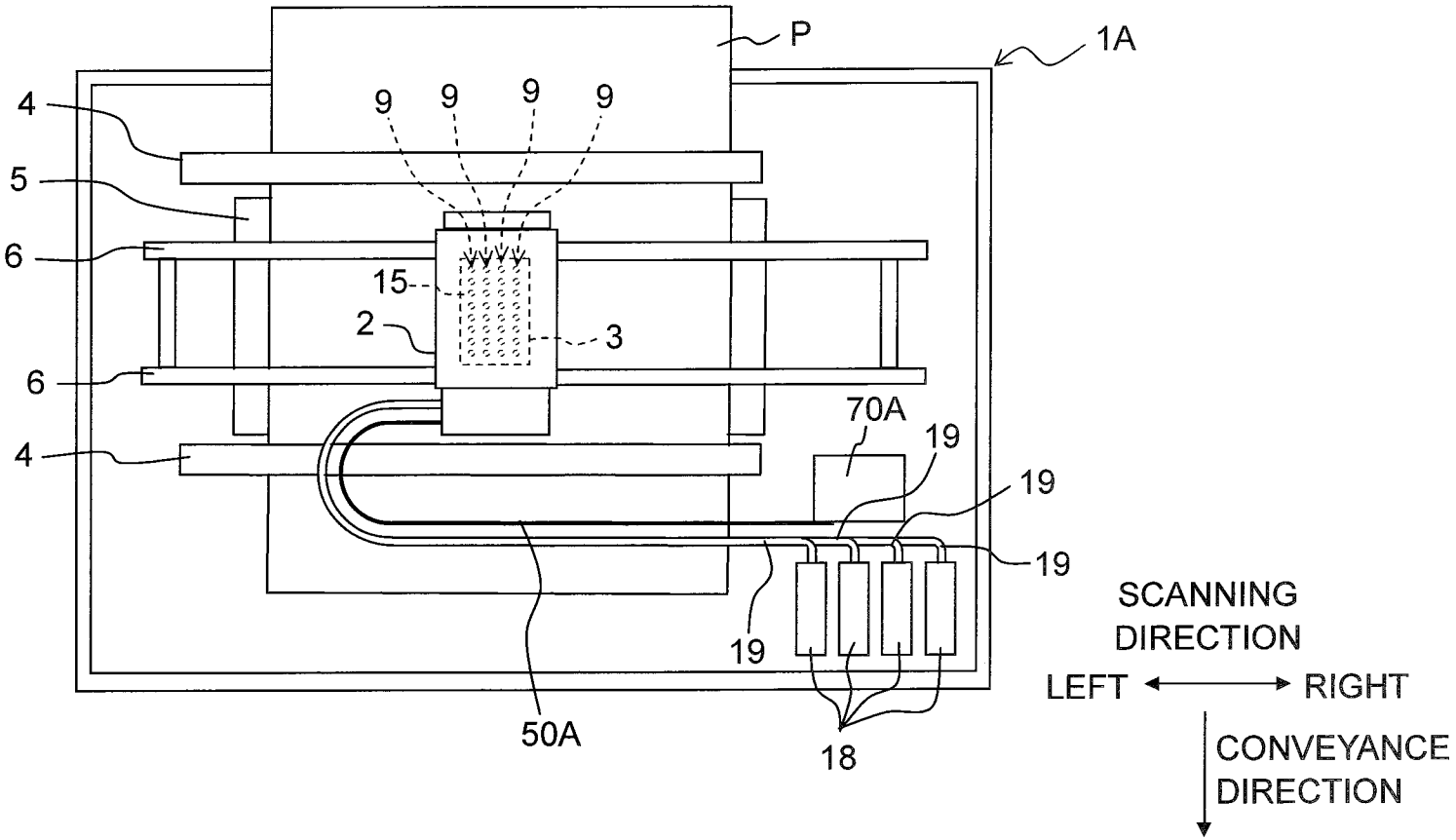
FIG. 1 is a schematic configuration diagram of a printer according to an embodiment of the present teaching.
Figure 2:
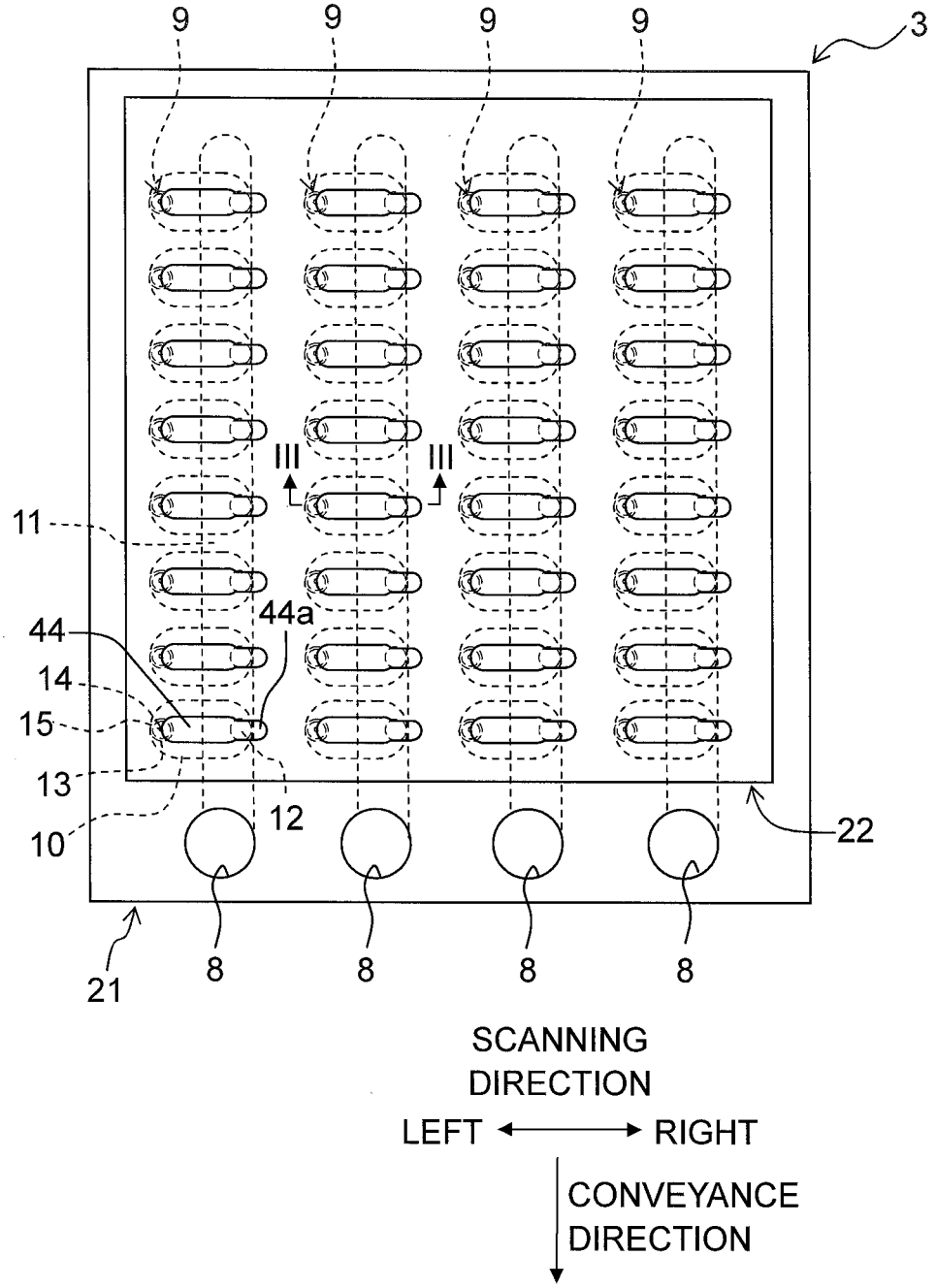
FIG. 2 is a plan view of an ink-jet head depicted in FIG. 1.
Figure 3:
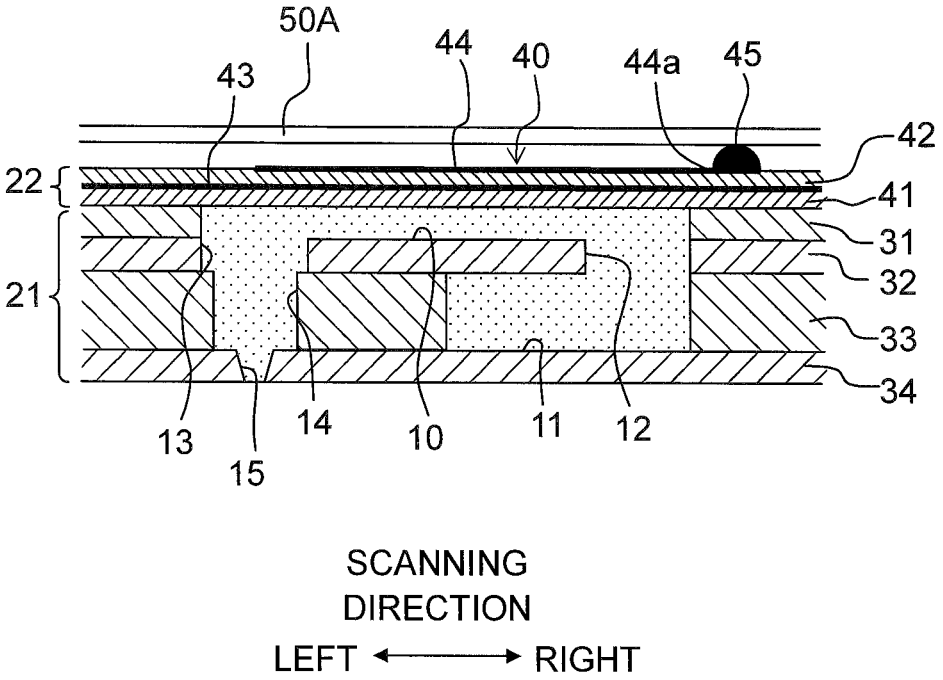
FIG. 3 is a cross-sectional view taken along the line III-III of FIG. 2.
Figure 4:
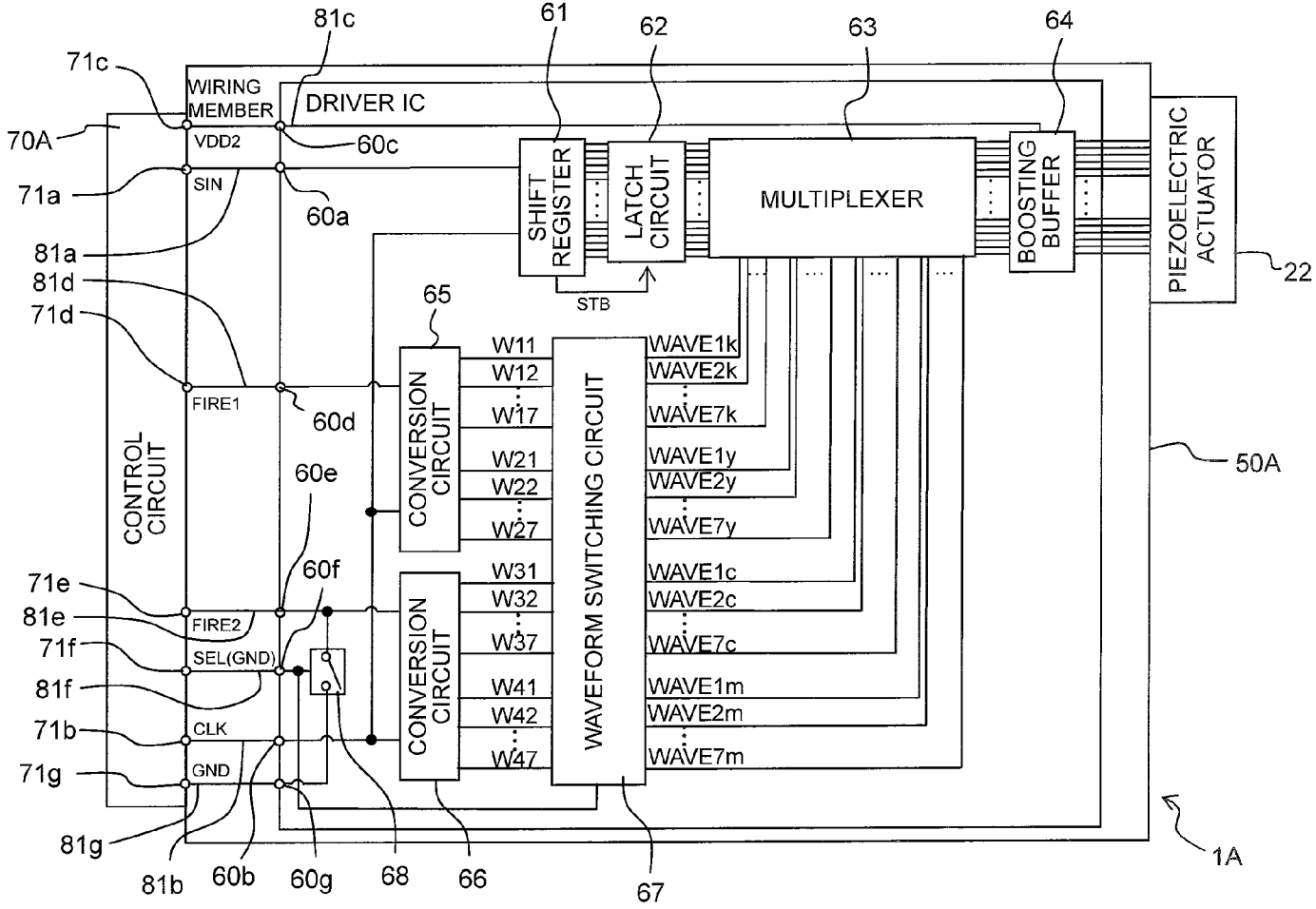
FIG. 4 depicts connection relations between a piezoelectric actuator, a driver IC, and a control circuit via a first wiring member.
Figure 6:
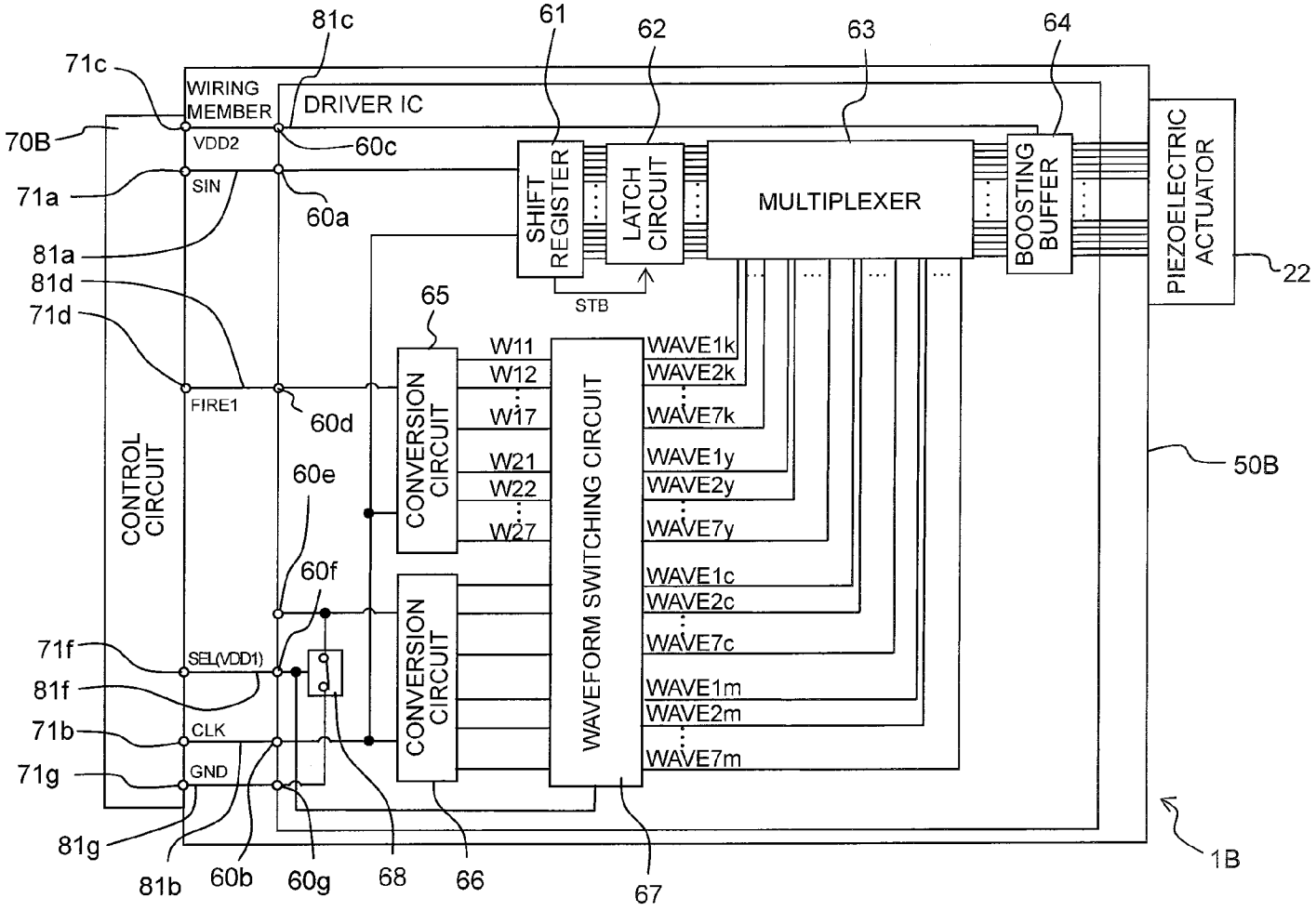
FIG. 6 depicts connection relations between the piezoelectric actuator, the driver IC, and the control circuit via a second wiring member.

This embodiment relates to two types of printers 1A and 1B each of which includes the same driver IC 60 (see FIG. 4 and FIG. 6). As depicted in FIG. 1, each of the printers 1A and 1B includes a carriage 2, an ink-jet head 3, a conveyance roller 4, a platen 5, and the like. The carriage 2 is supported by two guide rails 6 extending in a scanning direction to reciprocate along the guide rails 6 in the scanning direction. In the following description, the right and the left in the scanning direction are defined as those indicated in FIG. 1. The printers 1A and 1B are of substantially the same structure, except for wiring members and control circuit configurations which will be described later, and thus FIGS. 1 to 3 only depict the printer 1A.

The ink-jet head 3, which is carried on the carriage 2, discharges ink(s) from nozzles 15 formed in the lower surface of the ink-jet head 3. The nozzles 15 are aligned in a conveyance direction orthogonal to the scanning direction to form nozzle rows 9. The ink-jet head 3 includes four nozzle rows 9 arranged in the scanning direction. The black ink is discharged from the nozzles 15 constituting the rightmost nozzle row 9, the yellow ink is discharged from the nozzles 15 constituting the second nozzle row 9 from the right, the cyan ink is discharged from the nozzles 15 constituting the third nozzle row 9 from the right, and the magenta ink is discharged from the nozzles 15 constituting the leftmost nozzle row 9.

The ink-jet head 3 is connected to four ink cartridges 18 via four tubes 19, respectively. The four ink cartridges 18 are disposed in the scanning direction. The rightmost ink cartridge 18 contains the black ink, the second ink cartridge 18 from the right contains the yellow ink, the third ink cartridge 18 from the right contains the cyan ink, and the leftmost ink cartridge 18 contains the magenta ink. The inks of four colors contained in the four ink cartridges 18 are supplied to the ink-jet head 3 via the four tubes 19, respectively.

The conveyance rollers 4, which are disposed on both sides of the ink-jet head 3 in the conveyance direction, convey a recording sheet P in the conveyance direction. The platen 5, which is disposed to face the lower surface of the ink-jet head 3, supports the recording sheet P conveyed by the conveyance rollers 4 from below.

The printers 1A and 1B perform print for the recording sheet P by conveying the recording sheet P with the conveyance rollers 4 and discharging the ink from the ink-jet head 3, which moves in the scanning direction together with the carriage 2.

<Ink-Jet Head>

Subsequently, an explanation will be made about the ink-jet head 3. The ink-jet head 3 includes a channel unit 21 and a piezoelectric actuator 22. The channel unit 21 is formed with ink channels including, for example, the nozzles 15 and pressure chambers 10 which will be described later. The piezoelectric actuator 22 applies pressure to the ink in each of the pressure chambers 10.

<Channel Unit>

The channel unit 21 is formed of four plates 31 to 34 stacked on top of each other. The three plates 31 to 33, except for the lowermost plate 34, are made of a metal material such as stainless steel. The lowermost plate 34 is made of a synthetic resin, such as polyimide, or the same metal material as that of the plates 31 to 33.

The nozzles 15 are formed in the plate 34. The nozzles 15 form the four nozzle rows 9 as described above. The plate 31 includes the pressure chambers 10 formed corresponding to the nozzles 15 individually. Each of the pressure chambers 10 has an approximately elliptical planar shape of which longitudinal direction is the scanning direction. The left end of each of the pressure chambers 10 overlaps with the corresponding one of the nozzles 15.

Circular through-holes 12 are formed at parts, of the plate 32, overlapping with the right ends of the pressure chambers 10. Further, circular through-holes 13 are formed at parts, of the plate 32, overlapping with the left ends of the pressure chambers 10.

Four manifold channels 11 corresponding to the four nozzle rows 9 are formed in the plate 33. Each of the manifold channels 11 extends in the conveyance direction across the pressure chambers 10 constituting the corresponding one of the nozzle rows 9. Each of the manifold channels 11 overlaps with substantially right parts of the pressure chambers 10 of the corresponding one of the nozzle rows 9. Inks are respectively supplied to the manifold channels 11 from ink supply ports 8, which are provided at downstream ends of the manifold channels 11 in the conveyance direction. Circular through-holes 14 are formed at parts, of the plate 33, overlapping with the through-holes 13.

In the channel unit 21 having the above configuration, the pressure chambers 10 communicate with each of the manifold channels 11 via the through-holes 12. Each of the pressure chambers 10 communicates with the corresponding one of nozzles 15 via the through-holes 13 and 14. Namely, the channel unit 21 includes individual ink channels each ranging from the exit of each manifold channel 11 to the nozzle 15 via the pressure chamber 10.

<Piezoelectric Actuator>

The piezoelectric actuator 22 includes a vibration plate 41, a piezoelectric layer 42, a common electrode 43, and individual electrodes 44. The vibration plate 41 is made of a piezoelectric material composed primarily of lead zirconate titanate, which is a mixed crystal of lead titanate and lead zirconate. The vibration plate 41 is disposed on the upper surface of the channel unit 21 to cover the pressure chambers 10. Unlike the piezoelectric layer 42 explained next, the vibration plate 41 may be made of an insulating material, such as synthetic resin, instead of the piezoelectric material. The piezoelectric layer 42, which is made of the same piezoelectric material as that of the vibration plate 41, extends on the upper surface of the vibration plate 41 across the pressure chambers 10.

The common electrode 43 is disposed between the vibration plate 41 and the piezoelectric layer 42 to extend along them. The common electrode 43 is always kept at a ground potential. The individual electrodes 44, which are provided corresponding to the pressure chambers 10 individually, are disposed on the upper surface of the piezoelectric layer 42. Each of the individual electrodes 44 has an approximately elliptical planar shape of which size is slightly smaller than the corresponding one of the pressure chambers 10. Each of the individual electrodes 44 is disposed to overlap with a center part of the corresponding one of the pressure chambers 10. The driver IC 60 as described later selectively applies the ground potential or a predetermined drive potential VDD2 (e.g., about 20 V) to each individual electrode 44. In the arrangement relation between each individual electrode 44 and the common electrode 43, a part, of the piezoelectric layer 42, sandwiched between each individual electrode 44 and the common electrode 43 is polarized in its thickness direction.

In the piezoelectric actuator 22 with the above structure, the parts overlapping with the pressure chambers 10 are drive elements 40 which apply pressure ("discharge energy" of the present teaching) to the ink in the respective pressure chambers 10. Of the drive elements 40, the drive elements 40 corresponding to the nozzles 15 which form the first and second nozzle rows 9 from the right, through which the black and yellow inks are discharged, correspond to "first drive elements" of the present teaching; and the drive elements 40 corresponding to the nozzles 15 which form the third and fourth nozzle rows 9 from the right, through which cyan and magenta inks are discharged, correspond to "second drive elements" of the present teaching.

Right ends of the individual electrodes 44 extend to positions not overlapping with the pressure chambers 10, respectively, and the tips of right ends of the individual electrodes 44 are connection terminals 44*a*. A bump 45 is formed on the upper surface of each connection terminal 44*a*.

In the printer 1A, the bumps 45 are connected to a first wiring member 50A disposed on the upper side of the piezoelectric actuator 22. The first wiring member 50A mounts the driver IC 60. The individual electrodes 44 are connected to the driver IC 60 via traces (wiring lines) formed in the first wiring member 50A. The driver IC 60 is connected to a control circuit 70A, which is provided on the side of the body of the printer 1A, via traces formed in the first wiring member 50A. As depicted in FIG. 1, the first wiring member 50A, which is drawn from the carriage 2 such that its width direction is substantially parallel to an up-down direction (the direction perpendicular to the sheet surface of FIG. 1), is connected to the control circuit 70A provided on the side of the body of the printer 1A.

In the printer 1B, the bumps 45 are connected to a second wiring member 50B disposed on the upper side of the piezoelectric actuator 22. The second wiring member 50B mounts the driver IC 60 having the same structure as that mounted on the first wiring member 50A. The individual electrodes 44 are connected to the driver IC 60 via traces formed in the second wiring member 50B. The driver IC 60 is connected to a control circuit 70B provided on the side of the body of the printer 1B via traces formed in the second wiring member 50B. The second wiring member 50B, which is drawn from the carriage 2 such that its width direction is substantially parallel to the up-down direction, is connected to the control circuit 70B provided on the side of the body of the printer 1B.

<Driver IC>

As depicted in FIG. 4 and FIG. 6, the driver IC 60 includes a shift register 61, a latch circuit 62, a multiplexer 63, a boosting buffer 64, conversion circuits 65 and 66, a waveform switching circuit 67, and a switching element 68. The driver IC 60 further includes terminals 60*a* to 60*g*.

A control signal SIN for the drive elements 40 is inputted from the terminal 60*a* to the shift register 61. The control signal SIN is a signal transmitted as a serial signal. Further, a clock CLK is inputted from the terminal 60*b* to the shift register 61. The shift register 61 converts, synchronously with the clock CLK, the inputted control signal SIN to a parallel signal for each nozzle 15 and then outputs the parallel signal to the latch circuit 62. The latch circuit 62 outputs, to the multiplexer 63, the control signal inputted from the shift register 61 when a strobe signal STB is inputted thereto.

The multiplexer 63 outputs a drive waveform for each drive element 40 to the boosting buffer 64 depending on the control signal inputted from the latch circuit 62. As will be described later, drive waveforms are inputted from the waveform switching circuit 67 to the multiplexer 63, the drive waveforms including seven drive waveforms WAVE1*k* to WAVE7*k* corresponding to the nozzles 15 from which the black ink is discharged, seven drive waveforms WAVE1*y* to WAVE7*y* corresponding to the nozzles 15 from which the yellow ink is discharged, seven drive waveforms WAVE1*c* to WAVE7*c* corresponding to the nozzles 15 from which the cyan ink is discharged, seven drive waveforms WAVE1*m* to WAVE7*m* corresponding to the nozzles 15 from which the magenta ink is discharged. The drive waveforms WAVE1*k* to WAVE7*k*, WAVE1*y* to WAVE7*y*, WAVE1*c* to WAVE7*c*, and WAVE1*m* to WAVE7*m* are pulse signals switching between the ground potential and a predetermined potential VDD1 (e.g., about 3.3 V). Jetting amounts of the black ink corresponding to the seven drive waveforms WAVE1*k* to WAVE7*k* respectively are different from each other. Jetting amounts of the yellow ink corresponding to the seven drive waveforms WAVE1*y* to WAVE7*y* respectively are different from each other. Jetting amounts of the cyan ink corresponding to the seven drive waveforms WAVE1*c* to WAVE7*c* respectively are different from each other. Jetting amounts of the magenta ink corresponding to the seven drive waveforms WAVE1*m* to WAVE7*m* respectively are different from each other.

The multiplexer 63 includes a circuit 63*k* which selectively outputs, to the boosting buffer 64, any of the seven drive waveforms WAVE1*k* to WAVE7*k* for each of the drive elements 40 corresponding to one of the nozzles 15 through which the black ink is discharged, depending on the control signal. The multiplexer 63 includes a circuit 63*y* which selectively outputs, to the boosting buffer 64, any of the seven drive waveforms WAVE1*y* to WAVE7*y* for each of the drive elements 40 corresponding to one of the nozzles 15 through which the yellow ink is discharged, depending on the control signal. The multiplexer 63 includes a circuit 63*c* which selectively outputs, to the boosting buffer 64, any of the seven drive waveforms WAVE1*c* to WAVE7*c* for each of the drive elements 40 corresponding to one of the nozzles 15 through which the cyan ink is discharged, depending on the control signal. The multiplexer 63 includes a circuit 63*m* which selectively outputs, to the boosting buffer 64, any of the seven drive waveforms WAVE1*m* to WAVE7*m* for each of the drive elements 40 corresponding to one of the nozzles 15 through which the magenta ink is discharged, depending on the control signal. The circuit 63*k* and the circuit 63*y* correspond to a "first multiplexer" of the present teaching, and the circuit 63*c* and the circuit 63*m* correspond to a "second multiplexer" of the present teaching.

The drive waveform for each drive element 40 is inputted from the multiplexer 63 to the boosting buffer 64, and the drive potential VDD2 is inputted from the terminal 60*c* to the boosting buffer 64. The boosting buffer 64 generates the drive signal for driving each drive element 40 by boosting the drive waveform for each drive element 40 inputted from the multiplexer 63 to the drive potential VDD2. Then, the boosting buffer 64 outputs the drive signal to the individual electrode 44 of each drive element 40. Accordingly, the potential of each individual electrode 44 is switched between the ground potential GND and the drive potential VDD2 to drive each drive element 40.

In this embodiment, the conversion circuit 65 and the circuits 63*k*, 63*y* of the multiplexer 63 correspond to a "first drive signal generation circuit" of the present teaching, and the conversion circuit 66 and the circuits 63*c*, 63*m* of the multiplexer 63 correspond to a "second drive signal generation circuit" of the present teaching.

A first waveform signal FIRE1 can be inputted from the terminal 60*d* (a "first waveform input part" of the present teaching) to the conversion circuit 65 (a "first drive waveform generation circuit" of the present teaching). The first waveform signal FIRE1 is used for transmitting seven drive waveforms W11 to W17 and seven drive waveforms W21 to W27 as a serial signal. The clock CLK is inputted from the terminal 60*b* to the conversion circuit 65. The conversion circuit 65 converts, synchronously with the clock CLK, the inputted first waveform signal FIRE1 to a parallel signal, thereby generating the drive waveforms W11 to W17 and the drive waveforms W21 to W27. Then, the conversion circuit 65 outputs the drive waveforms W11 to W17 and the drive waveforms W21 to W27 to the waveform switching circuit 67. The drive waveforms W11 to W17 and the drive waveforms W21 to W27 are pulse signals switching between the ground potential and the predetermined potential VDD1. In this embodiment, the drive waveforms W11 to W17 and the drive waveforms W21 to W27 correspond to a "first drive waveform" of the present teaching.

A second waveform signal FIRE2 can be inputted from the terminal 60*e* (a "second waveform input part" of the present teaching) to the conversion circuit 66 (a "second drive waveform generation circuit" of the present teaching). The second waveform signal FIRE2 is used for transmitting seven drive waveforms W31 to W37 and seven drive waveforms W41 to W47 as a serial signal. The clock CLK is inputted from the terminal 60*b* to the conversion circuit 66. The conversion circuit 66 converts, synchronously with the clock CLK, the inputted second waveform signal FIRE2 to a parallel signal, thereby generating the drive waveforms W31 to W37 and the drive waveforms W41 to W47. Then, the conversion circuit 66 outputs the drive waveforms W31 to W37 and the drive waveforms W41 to W47 to the waveform switching circuit 67. The drive waveforms W31 to W37 and the drive waveforms W41 to W47 are pulse signals switching between the ground potential and the predetermined potential VDD1. In this embodiment, the drive waveforms W31 to W37 and the drive waveforms W41 to W47 correspond to a "second drive waveform" of the present teaching.

A switching signal SEL is inputted from the terminal 60*f* (a "switching signal input part" of the present teaching) to the waveform switching circuit 67. The switching signal SEL is either a signal of the ground potential (a "first switching signal" of the present teaching) or a signal of the predetermined potential VDD1 (a "second switching signal" of the present teaching).

Figure 5:
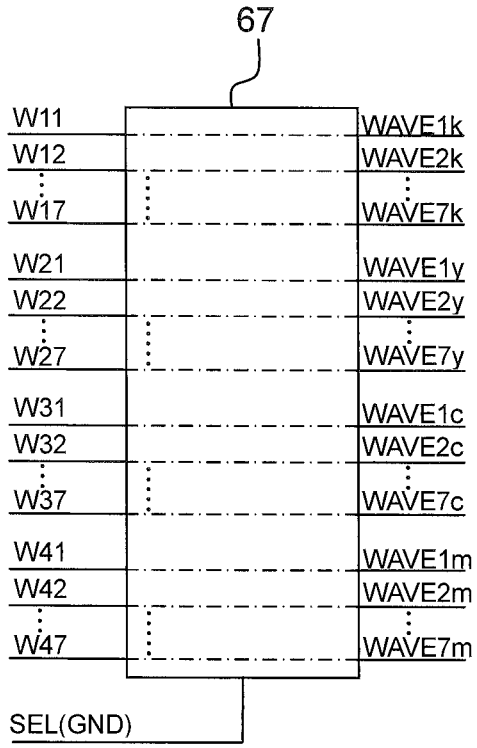
FIG. 5 depicts a connection relation between input and output in a waveform switching circuit depicted in FIG. 4.

In the waveform switching circuit 67, when the switching signal SEL is the signal of the ground potential, the drive waveforms W11 to W17 are outputted as the drive waveforms WAVE1*k* to WAVE7*k*, as depicted in FIG. 5. Further, in the waveform switching circuit 67, the drive waveforms W21 to W27 are outputted as the drive waveforms WAVE1*y* to WAVE7*y*, the drive waveforms W31 to W37 are outputted as the drive waveforms WAVE1*c* to WAVE7*c*, and the drive waveforms W41 to W47 are outputted as the drive waveforms WAVE1*m* to WAVE7*m*. Thus, the drive elements 40, which correspond to the nozzles 15 through which black, yellow, cyan, and magenta inks are discharged respectively, may be supplied with mutually different drive waveforms for driving the drive elements 40, depending on the ink colors. For example, in a case that the recording sheet P conveyed by the conveyance rollers 4 has a wavy shape along the scanning direction, distance to the recording sheet P may be different among the nozzles 15 through which black, yellow, cyan, and magenta inks are discharged respectively. In that case, the nozzles 15, through which black, yellow, cyan, and magenta inks are discharged respectively, may have, for example, ink-discharge timing different from each other, depending on ink-discharge delay time which is incorporated in advance into the drive waveforms.

Figure 7:
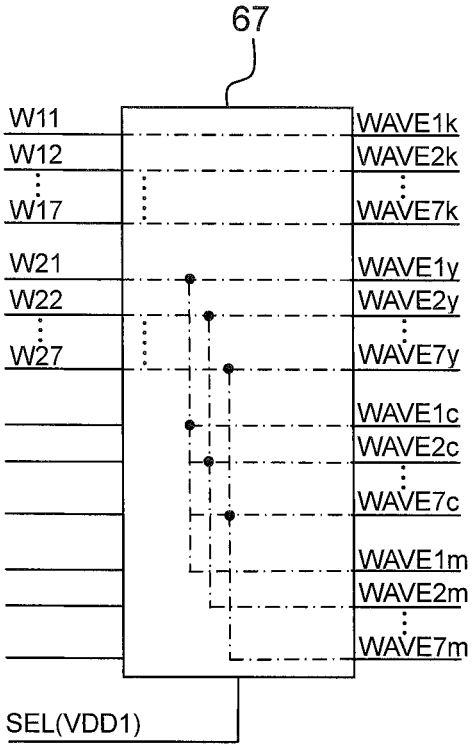
FIG. 7 depicts a connection relation between input and output in a waveform switching circuit depicted in FIG. 6.

In the waveform switching circuit 67, when the switching signal SEL is the signal of the predetermined potential VDD1, the drive waveforms W11 to W17 are outputted as the drive waveforms WAVE1*k* to WAVE7*k*, as depicted in FIG. 7. Further, in the waveform switching circuit 67, the drive waveforms W21 to W27 are outputted as the drive waveforms WAVE1*y* to WAVE7*y*, the drive waveforms WAVE1*c* to WAVE7*c*, and the drive waveforms WAVE1*m* to WAVE7*m*. Thus, in that case, the drive elements 40 corresponding to the nozzles 15 through which the black ink is discharged may have drive waveforms for driving the drive elements 40 which are different from those of the drive elements 40 corresponding to the nozzles 15 through which the color inks (yellow, cyan, and magenta inks) are discharged respectively. Meanwhile, the drive elements 40 corresponding to the nozzles 15 through which yellow, cyan, and magenta inks are discharged respectively have the drive waveforms for driving the drive elements 40 in common.

<Switching Element>

Figure 8:
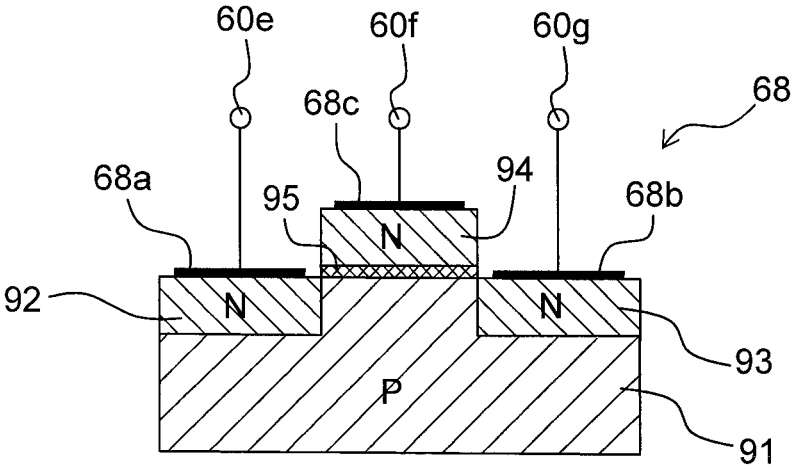
FIG. 8 depicts a structure of a switching element depicted in each of FIG. 4 and FIG. 6.

The switching element 68 (an "input switching circuit" of the present teaching) is constructed of a Nch-MOSFET as depicted in FIG. 8. The switching element 68 includes a P-type semiconductor 91 which is a base and three N-type semiconductors 92 to 94 disposed on the P-type semiconductor 91. The N-type semiconductors 92 and 93 are disposed at both ends of the P-type semiconductor 91 in one direction, thereby forming a source 68*a* (a "first connection part" of the present teaching) and a drain 68*b* (a "second connection part" of the present teaching). A part, of the P-type semiconductor, positioned in the center in the one direction allows the N-type semiconductors 92 and 93 to separate from each other. The N-type semiconductor 94, which is disposed on the surface of the part of the P-type semiconductor 91 separating the N-type semiconductors 92 and 93, forms a gate 68*c* (a "third connection part" of the present teaching). An oxide film 95 for insulation is disposed between the N-type semiconductor 94 and the P-type semiconductor 91. Since the Nch-MOSFET itself is well known, any more details about the configuration of the switching element 68 will be omitted.

The source 68*a* of the switching element 68 is connected to the terminal 60*e* to which the second waveform signal FIRE2 is inputted. The drain 68*b* of the switching element 68 is connected to the terminal 60*g*. The terminal 60*g* is kept at the ground potential. This allows the drain 68*b* to be kept at the ground potential (a "predetermined constant potential" of the present teaching). The gate 68*c* of the switching element 68 is connected to the terminal 60*f* to which the switching signal SEL is inputted. When the potential of the gate 68*c* is not more than a predetermined threshold value Vh, the switching element 68 breaks the conduction between the source 68*a* and the drain 68*b*. When the potential of the gate 68*c* exceeds the predetermined threshold value Vh, the switching element 68 electrically connects the source 68 and the drain 68*b*. The threshold value Vh is an electric potential (e.g., about 0.8 to 0.9 V) between the ground potential and the predetermined potential VDD1.

Thus, when the switching signal SEL is the signal of the ground potential, the switching element 68 breaks the conduction between the source 68*a* and the drain 68*b*. This makes it impossible to keep the terminal 60*e* at the ground potential, resulting in the input of the second waveform signal FIRE2 from the terminal 60*e*. When the switching signal SEL is the signal of the predetermined potential VDD1, the switching element 68 connects the source 68*a* and the drain 68*b*. This allows the terminal 60*e* to be kept at the ground potential, thereby blocking the input of the signal from the terminal 60*e*.

<First Wiring Member>

Subsequently, an explanation will be made about the first wiring member 50A. The first wiring member 50A includes traces 81*a* to 81*g*. The control circuit 70A to be connected to the driver IC 60 via the first wiring member 50A includes terminals 71*a* to 71*g*.

The control signal SIN is outputted from the terminal 71*a*. The trace 81*a* connects the terminal 60*a* and the terminal 71*a*. The clock CLK is outputted from the terminal 71*b*. The trace 81*b* connects the terminal 60*b* and the terminal 71*b*. The drive potential VDD2 is outputted from the terminal 71*c*. The trace 81*c* connects the terminal 60*c* and the terminal 71*c*. The first waveform signal FIRE is outputted from the terminal 71*d*. The trace 81*d* (a "first waveform trace" of the present teaching) connects the terminal 60*d* and the terminal 71*d*. The second waveform signal FIRE2 is outputted from the terminal 71*e*. The trace 81*e* (a "second waveform trace" of the present teaching) connects the terminal 60*e* and the terminal 71*e*. The switching signal SEL is outputted from the terminal 71*f*. The switching signal SEL outputted from the control circuit 70A is the signal of the ground potential. The trace 81*f* (a "first switching trace" of the present teaching) connects the terminal 60*f* and the terminal 71*f*. The ground potential is outputted from the terminal 71*g*. The trace 81*g* connects the terminal 60*g* and the terminal 71*g*.

<Second Wiring Member>

Subsequently, an explanation will be made about the second wiring member 50B. The second wiring member 50B includes traces 81*a* to 81*d*. 81*f*, and 81*g* similar to those in the first wiring member 50A. The control circuit 70B to be connected to the driver IC 60 via the second wiring member 50B includes terminals 71*a* to 71*d*, 71*f*, and 71*g* similar to those in the control circuit 70A. Unlike the control circuit 70A, the control circuit 70B does not include the terminal outputting the second waveform signal FIRE2 (the terminal corresponding to the terminal 71*e*). Thus, unlike the first wiring member 50A, the second wiring member 50B does not include the trace transmitting the second waveform signal FIRE2 (the trace corresponding to the trace 81*e*). In this embodiment, the wiring member 81*f* of the second wiring member 50B corresponds to a "second switching trace" of the present teaching.

<Manufacturing Method of Printer>

Figure 9A:
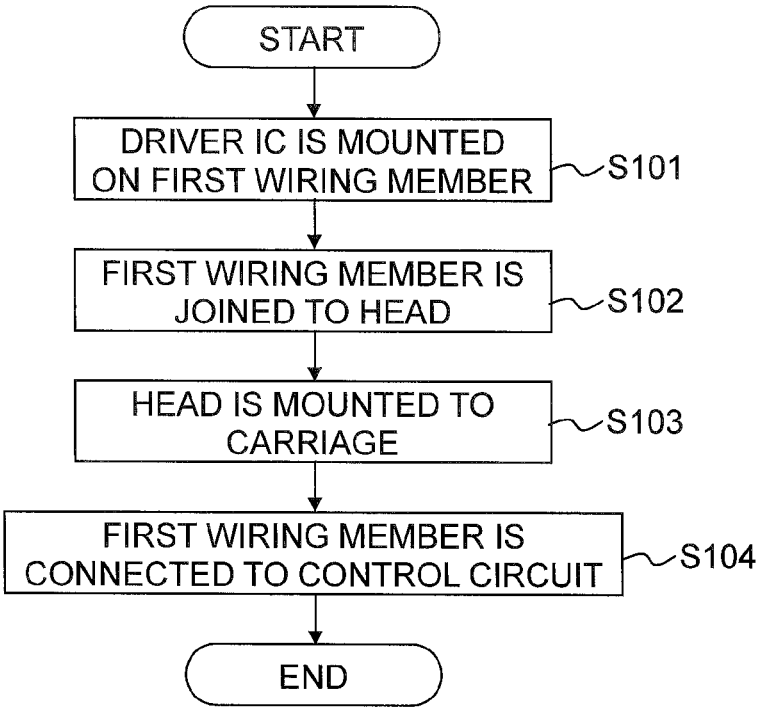
FIG. 9A is a flowchart indicating a procedure for assembling a carriage, the ink-jet head, the first wiring member, the driver IC, and a controller at the time of manufacture of the printer.

Subsequently, an explanation will be made about a method of assembling the carriage 2, the ink-jet head 3, the first wiring member 50A, the driver IC 60, and the control circuit 70A at the time of manufacture of the printer 1A. To assemble them together, at first, the driver IC 60 is mounted on a surface of the first wiring member 50A (S101), as indicated in FIG. 9A. This connects the terminals 60*a* to 60*g* and the traces 81*a* to 81*g*, respectively.

Next, the first wiring member 50A is joined to the upper surface of the ink-jet head 3 to connect the individual electrodes 44 of the piezoelectric actuator 22 and the driver IC 60 (S102). Then, the ink-jet head 3 joined to the first wiring member 50A is mounted to the carriage 2 of the printer 1A (S103). After that, the first wiring member 50A is connected to the control circuit 70A provided on the side of the body of the printer 1A (S104). This connects the terminals 71*a* to 71*g* and the traces 81*a* to 81*g*, respectively.

Figure 9B:
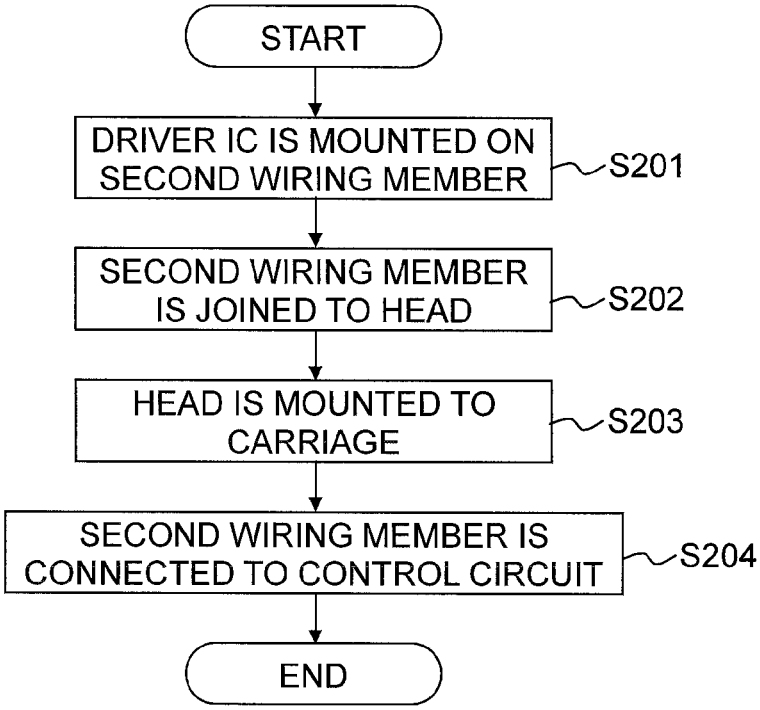
FIG. 9B is a flowchart indicating a procedure for assembling the carriage, the ink-jet head, the second wiring member, the driver IC, and the controller at the time of manufacture of the printer.

Subsequently, an explanation will be made about a method of assembling the carriage 2, the ink-jet head 3, the second wiring member 50B, the driver IC 60, and the control circuit 70B at the time of manufacture of the printer 1B. To assemble them together, at first, the driver IC 60 is mounted on a surface of the second wiring member 50B (S201), as indicated in FIG. 9B. This connects the terminals 60*a* to 60*d*, 60*f*, and 60*g* and the traces 81*a* to 81*d*, 81*f*, and 81*g* respectively. The terminal 60*e* is connected to no trace of the second wiring member 50B.

Next, the second wiring member 50B is joined to the upper surface of the ink-jet head 3 to connect the individual electrodes 44 of the piezoelectric actuator 22 and the driver IC 60 (S202). Then, the ink-jet head 3 joined to the second wiring member 50B is mounted to the carriage 2 of the printer 1B (S203). After that, the second wiring member 50B is connected to the control circuit 70B provided on the side of the body of the printer 1B (S204). This connects the terminals 71*a* to 71*d*, 71*f*, and 71*g* and the traces 81*a* to 81*d*, 81*f*, and 81*g* respectively.

In the driver IC 60 of this embodiment, when the switching signal SEL to be inputted from the terminal 60*f* is the signal of the ground potential, the conduction between the source 68*a* and the drain 68*b* of the switching element 68 is broken. This allows the first waveform signal FIRE1 to be inputted from the terminal 60*d* and allows the second waveform signal FIRE2 to be inputted from the terminal 60*e*. In that case, in the waveform switching circuit 67 of the driver IC 60, the drive waveforms W11 to W17 are outputted as the drive waveforms WAVE1*k* to WAVE7*k*; the drive waveforms W21 to W27 are outputted as the drive waveforms WAVE1*y* to WAVE7*y*; the drive waveforms W31 to W37 are outputted as the drive waveforms WAVE1*c* to WAVE7*c*; and the drive waveforms W41 to W47 are outputted as the drive waveforms WAVE1*m* to WAVE7*m*. Thus, the driver IC 60 can be used as the driver IC driving the ink-jet head 3 of the printer 1A in which the drive elements 40, which correspond to the nozzles 15 through which black, yellow, cyan, and magenta inks are discharged respectively, have mutually different drive waveforms for driving the drive elements 40, depending on the ink colors.

In the driver IC 60 of this embodiment, when the switching signal SEL to be inputted from the terminal 60*f* is the signal of the predetermined potential VDD1, the source 68*a* of the switching element 68 is electrically conducted with the drain 68*b* of the switching element 68. This allows for the input of the first waveform signal FIRE1 from the terminal 60*d* and blocks the input of the second waveform signal FIRE2 from the terminal 60*e*. In that case, in the waveform switching circuit 67 of the driver IC 60, the drive waveforms W11 to W17 are outputted as the drive waveforms WAVE1*k* to WAVE7*k*; and the drive waveforms W21 to W27 are outputted as the drive waveforms WAVE1*y* to WAVE7*y*, the drive waveforms WAVE1*c* to WAVE7*c*, and the drive waveforms WAVE1*m* to WAVE7*m*. Thus, the driver IC 60 can be used as the driver IC driving the ink-jet head 3 of the printer 1B in which the drive elements 40, which correspond to the nozzles 15 through which the black ink is discharged, have drive waveforms for driving the drive elements 40 which are different from those of the drive elements 40, which correspond to the nozzles 15 through which the color inks (yellow, cyan, and magenta inks) are discharged respectively, and the drive elements 40, which correspond to the nozzles 15 through which yellow, cyan, and magenta inks are discharged respectively, have the drive waveforms for driving the drive elements 40 in common.

As described above, in this embodiment, the driver IC 60 can be used both as the driver IC driving the ink-jet head 3 of the printer 1A in which the drive elements 40, which correspond to the nozzles 15 from which yellow, cyan, and magenta inks are discharged respectively, are driven with mutually different drive waveforms and as the driver IC driving the ink-jet head 3 of the printer 1B in which the drive elements 40, which correspond to the nozzles 15 from which yellow, cyan, and magenta inks are discharged respectively, are driven with the common waveform signals.

Although the driver IC exclusive to the ink-jet head 3 of the printer 1A and the driver IC exclusive to the ink-jet head 3 of the printer 1B may be used respectively, this needs separately designed driver ICs, leading to the increase in man-hours for development and development costs. This embodiment, however, can prevent the increase in man-hours for development and development costs for the driver IC, because the driver IC 60 can be used both as the driver IC driving the ink-jet head 3 of the printer 1A and as the driver IC driving the ink-jet head 3 of the printer 1B.

In this embodiment, when the driver IC 60 is used as the driver IC driving the ink-jet head 3 of the printer 1B, the source 68*a* of the switching element 68 is electrically conducted with the drain 68*b* of the switching element 68 to keep the terminal 60*e* at the ground potential, thereby blocking the input of the signal from the terminal 60*e*. This prevents the electrical potential of the terminal 60*e* from becoming unstable which would be otherwise caused by, for example, the influence of noise.

In this embodiment, when the conduction between the source 68*a* and the drain 68*b* is broken, the switching element 68 makes the drain 68*b* and the gate 68*c* have the same ground potential. When the switching element 68 constructed of the Nch-MOSFET breaks down, the drain 68*b* and the gate 68*c* may be short-circuited. However, since the drain 68*b* and the gate 68*c* have the same potential, the short-circuit between the drain 68*b* and the gate 68*c* does not cause great current to pass therebetween and the conduction between the source 68*a* and the drain 68*b* may be avoided. Accordingly, when the switching element 68 breaks down to cause the short-circuit between the drain 68*b* and the gate 68*c* in the printer 1A, it is possible to prevent the switching from the state in which the drive waveforms W31 to W37 are outputted as the drive waveforms WAVE1*c* to WAVE7*c* and the drive waveforms W41 to W47 are outputted as the drive waveforms WAVE1*m* to WAVE7*m*, to the state in which the drive waveforms W21 to W27 are outputted as the drive waveforms WAVE1*c* to WAVE7*c* and the drive waveforms WAVE1*m* to WAVE7*m*.

In this embodiment, although the first wiring member 50A includes the trace 81*e* transmitting the second waveform signal FIRE2, the second wiring member 50B includes no trace transmitting the second waveform signal FIRE2. This makes the second wiring member 50B smaller in width than the first wiring member 50A. In the printers 1A and 1B, the wiring members 50A and 50B are drawn from the carriage 2 such that their width directions are substantially parallel to the up-down direction, and the drawn wiring members 50A and 50B are connected to the control circuits 70A and 70B, respectively. Thus, the printers 1A and 1B are larger in the up-down direction, as the widths of the wiring members are greater. In this embodiment, since the second wiring member 50B is smaller in width than the first wiring member 50A, the printer 1B with the second wiring member 50B is lower in height than the printer 1A with the first wiring member 50A.

Some user may put print quality ahead of printer size. In that case, for example, the print quality is high but the printer is large in size. Some user may put printer size ahead of print quality. In that case, for example, the printer is small in size but the printer quality is low.

In the printer 1A, the first wiring member 50A includes the trace 81*e* transmitting the second waveform signal FIRE2. In that case, the drive signals can be generated by using the drive waveforms different from each other depending on the ink colors, which improves the print quality. The printer 1A, however, includes the first wiring member 50A larger in width than the second wiring member 50B, and thus the printer 1 is longer in length in the up-down direction than the printer 1B. Namely, the printer 1A is larger in size than the printer 1B.

In the printer 1B, the second wiring member 50B includes no trace transmitting the second waveform signal FIRE2. In that case, the drive signals for three color inks are generated by using the common drive waveforms, and thus the print quality of the printer 1B is inferior to that of the printer 1A. The printer 1B, however, includes the second wiring member 50B smaller in width than the first wiring member 50A, and thus the printer 1B is shorter in length in the up-down direction than the printer 1A and it is prevented from growing in size.

In this embodiment, the driver IC 60 can be used both as the driver IC for the printer 1A which is configured to put the print quality ahead of the printer size and as the driver IC for the printer 1B which is configured to put the printer size ahead of the print quality.

Subsequently, an explanation will be made about modified embodiments in which various changes or modifications are made to the above embodiment.

In the above embodiment, the drain 68*b* of the switching element 68 is kept at the ground potential and the switching signal SEL to be outputted from the terminal 71*f* of the control circuit 70A is the signal of the ground potential. The present teaching, however, is not limited thereto. For example, the drain 68*b* of the switching element 68 may be kept at a constant potential other than the ground potential, and the switching signal SEL to be outputted from the terminal 71*f* of the control circuit 70A may be a signal of the constant potential. Alternatively, the switching signal SEL to be outputted from the terminal 71*f* of the control circuit 70A may be a signal with electrical potential which is not more than the threshold value Vh and is different from that of the drain 68*b* of the switching element 68.

In the above embodiment, the Nch-MOSFET constitutes the switching element 68. The present teaching, however, is not limited thereto. Any other transistor than the Nch-MOSFET may constitute the switching element 68. Such a switching element 68 may break the conduction between the terminal 60*e* and the terminal 60*g* when the electric potential of a part to which the switching signal SEL is inputted is the ground potential. In that case, even if the switching element 68 breaks down to cause the short-circuit between the drain 68*b* and the gate 68*c* in the printer 1A, it is possible to prevent the switching from the state in which the drive waveforms W31 to W37 are outputted as the drive waveforms WAVE1*c* to WAVE7*c* and the drive waveforms W41 to W47 are outputted as the drive waveforms WAVE1*m* to WAVE7*m*, to the state in which the drive waveforms W21 to W27 are outputted as the drive waveforms WAVE1*c* to WAVE7*c* and the drive waveforms WAVE1*m* to WAVE7*m*. The switching element 68 may be formed of any other element than the transistor.

In the above embodiment, the input of the signal from the terminal 60*e* to the conversion circuit 66 is switched between allowed or not allowed based on whether or not the terminal 60*e* is kept at the ground potential. The present teaching, however, is not limited thereto.

Figure 10A:
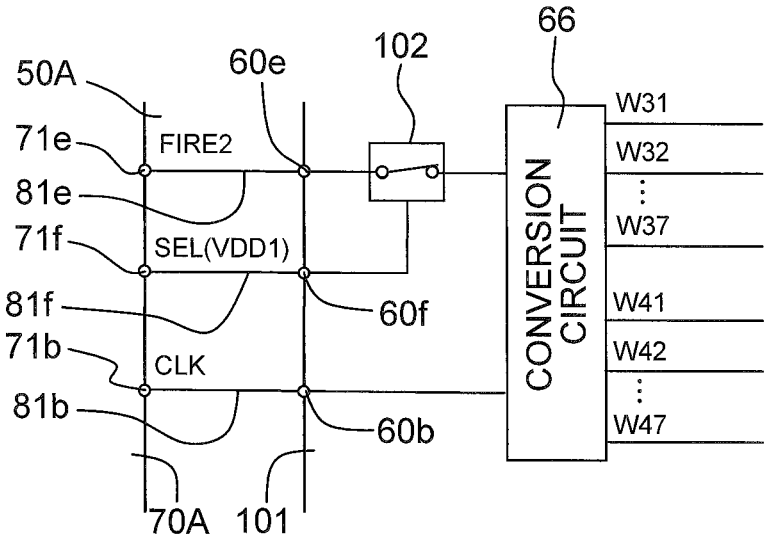
FIG. 10A depicts a connection relation between the driver IC and the control circuit via the first wiring member according to a first modified embodiment.
Figure 10B:
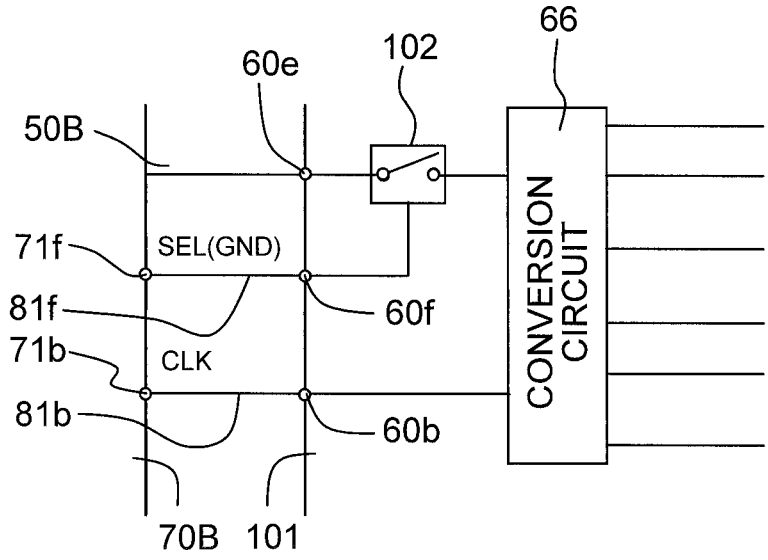
FIG. 10B depicts a connection relation between the driver IC and the control circuit via the second wiring member according to the first modified embodiment.

In the first modified embodiment, as depicted in FIGS. 10A and 10B, a driver IC 101 includes a switching element 102 (the "input switching circuit" of the present teaching) disposed between the terminal 60*e* and the conversion circuit 66. The switching element 102 is constructed of the transistor or the like. The switching signal SEL is inputted from the terminal 60*f* to the switching element 102. When the switching signal SEL is the signal of the predetermined potential VDD1, the switching element 102 electrically connects the terminal 60*e* and the conversion circuit 66. This allows the second waveform signal FIRE2 to be inputted from the terminal 60*e* to the conversion circuit 66. When the switching signal SEL is the signal of the ground potential, the switching element 102 breaks the conduction between the terminal 60*e* and the conversion circuit 66. This blocks the input of the signal from the terminal 60*e* to the conversion circuit 66. Unlike the above embodiment, in the first modified embodiment, the switching signal SEL to be outputted from the terminal 71*f* of the control circuit 70A of the printer 1A is the signal of the predetermined potential VDD1 (the "first switching signal" of the present teaching), as depicted in FIG. 10A. The switching signal SEL to be outputted from the terminal 71*f* of the control circuit 70B of the printer 1B is the signal of the ground potential (the "second switching signal" of the present teaching), as depicted in FIG. 10B.

In the above embodiment, the input of the signal from the terminal 60*e* to the conversion circuit 66 is switched between allowed or not allowed by switching as to which one of the signal of the ground potential and the signal of the predetermined potential VDD1 is inputted to the terminal 60*f* as the switching signal SEL. The present teaching, however, is not limited thereto. For example, the input of the signal from the terminal 60*e* to the conversion circuit 66 may be switched between allowed or not allowed by performing switching between the state in which the switching signal SEL of the predetermined potential VDD1 is inputted to the terminal 60*f* and the state in which the terminal 60*f* is released to prevent the switching signal SEL from being inputted.

Figure 11A:
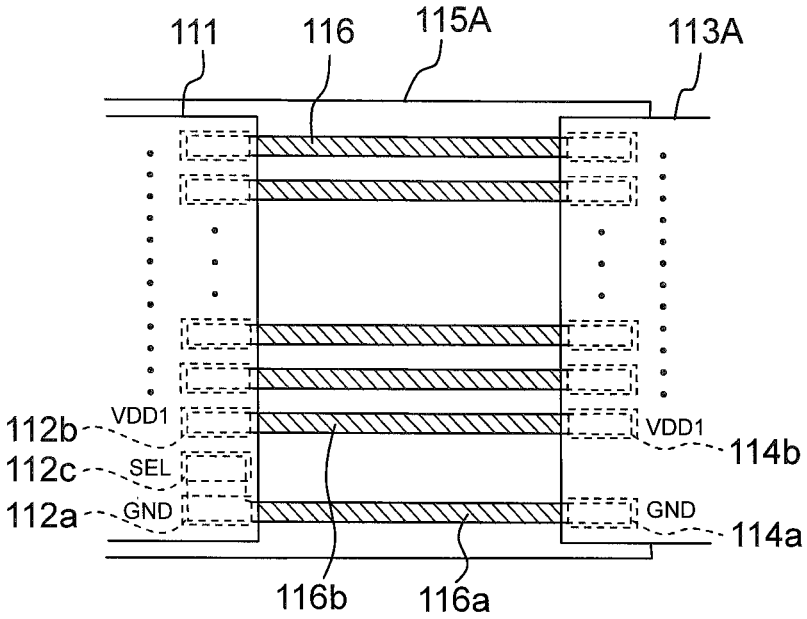
FIG. 11A depicts a connection relation between the driver IC and the control circuit via the first wiring member according to a second modified embodiment.
Figure 11B:
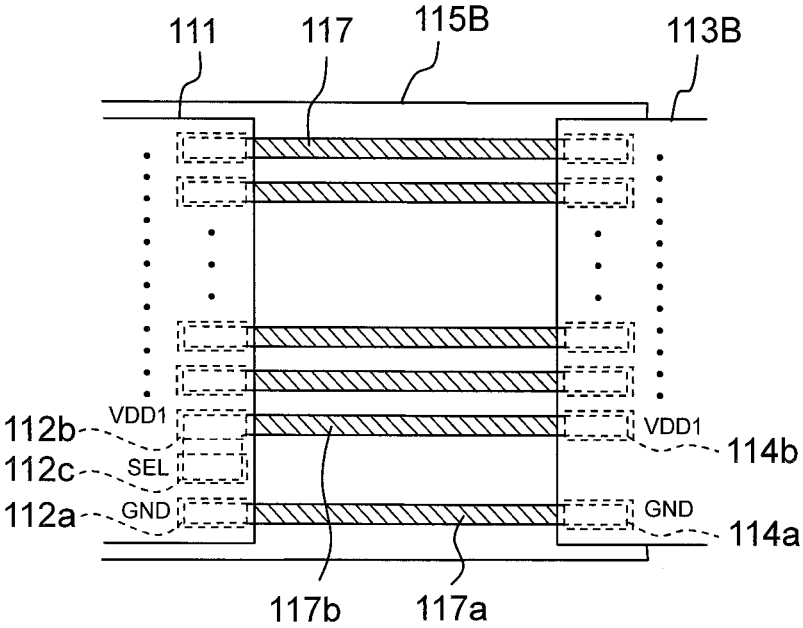
FIG. 11B depicts a connection relation between the driver IC and the control circuit via the second wiring member according to the second modified embodiment.

In the printer 1A of the above embodiment, the trace 81*f* of the first wiring member 50A connects the terminal 60*f* and the terminal 71*f*, and in the printer 1B of the above embodiment, the trace 81*f* of the second wiring member 50B connects the terminal 60*f* and the terminal 71*f*. The present teaching, however, is not limited thereto. In the printer 1A of the second modified embodiment, as depicted in FIGS. 11A and 11B, terminals 112 are disposed in a row at an end of a driver IC 111. The terminals 112 include a terminal 112*a* to which the predetermined potential VDD1 is inputted, a terminal 112*b* to which the ground potential is inputted, and a terminal 112*c* (the "switching signal input part" of the present teaching) to which the switching signal SEL is inputted. The terminal 112*c* is disposed between the terminal 112*a* and the terminal 112*b*. Of the terminals 112, any other remaining terminals than the terminals 112*a* to 112*c* are, for example, terminals similar to the terminals 60*a* to 60*e* described in the above embodiment, and thus explanation thereof will be omitted.

In the second modified embodiment, terminals 114 are disposed in a row at an end of a control circuit 113A of the printer 1A and an end of a control circuit 113B of the printer 1B, respectively. The terminals 114 include a terminal 114*b* outputting the predetermined potential VDD1 and a terminal 114*a* outputting the ground potential. Of the terminals 114, any other remaining terminals than the terminals 114*a* and 114*b* are, for example, terminals similar to the terminals 71*a* to 71*e* described in the above embodiment, and thus explanation thereof will be omitted.

As depicted in FIG. 11A, the printer 1A includes a first wiring member 115A provided with traces 116 connecting the terminals 112 and the terminals 114. The traces 116 include a trace 116*a* connecting the terminal 112*a* and the terminal 114*a* and a trace 116*b* connecting the terminal 112*b* and the terminal 114*b*. The trace 116*a* causes the short-circuit between the terminals 112*a* and 112*c*. This allows the electrical potential of the switching signal SEL, which is to be inputted from the terminal 112*c*, to be the ground potential. In that case, the trace 116*a* corresponds to the "first switching trace" of the present teaching. Of the traces 116, any other remaining traces than the traces 116*a* and 116*b* are, for example, traces similar to the traces 81*a* to 81*e* described in the above embodiment, and thus explanation thereof will be omitted.

As depicted in FIG. 11B, the printer 1B includes a second wiring member 115B provided with traces 117 connecting the terminals 112 and the terminals 114. The traces 117 include a trace 117*a* connecting the terminal 112*a* and the terminal 114*a* and a trace 117*b* connecting the terminal 112*b* and the terminal 114*b*. The trace 117*b* causes the short-circuit between the terminals 112*b* and 112*c*. This allows the electrical potential of the switching signal SEL, which is to be inputted from the terminal 112*c*, to be the predetermined potential VDD1. In that case, the trace 117*b* corresponds to the "second switching trace" of the present teaching. Of the traces 117, any other remaining traces than the traces 117*a* and 117*b* are, for example, traces similar to the traces 81*a* to 81*e* described in the above embodiment, and thus explanation thereof will be omitted.

In the above embodiment, the driver IC 60 includes the waveform switching circuit 67. The driver IC, however, may not include the waveform switching circuit 67. Even in that case, the driver IC may be used, for example, as any of the driver IC of the printer 1A and a driver IC of a printer in which the ink-jet head includes two nozzle rows 9.

In the above embodiment, each of all the drive elements 40 is provided corresponding to a set of the shift register 61, the latch circuit 62, the multiplexer 63, and the boosting buffer 64 constituting the first drive signal generation circuit and the second drive signal generation circuit of the present teaching. The present teaching, however, is not limited thereto. For example, the following configuration is also allowable. Namely, the drive elements 40 for the nozzles 15 from which black and yellow inks are discharged respectively are provided corresponding to a set of the shift register 61, the latch circuit 62, the multiplexer 63, and the boosting buffer 64 constituting the first drive signal generation circuit of the present teaching; and the drive elements 40 for the nozzles 15 from which cyan and magenta inks are discharged respectively are provided corresponding to a set of the shift register 61, the latch circuit 62, the multiplexer 63, and the boosting buffer 64 constituting the second drive signal generation circuit of the present teaching.

In the above embodiment, the nozzles 15 of each of the nozzle rows 9 have the constant discharge timing and types of waveform signals to be inputted are up to two types of waveform signals including the FIRE1 and the FIRE2. The present teaching, however, is not limited thereto. For example, the nozzles 15, of each of the nozzle rows 9, disposed upstream in the conveyance direction may have discharge timing different from that of the nozzles 15 disposed downstream in the conveyance direction. The waveform signals to be inputted may be more than the two types of waveform signals. For example, when the drive elements 40 corresponding to the nozzles 15 which are disposed upstream in the conveyance direction have a drive waveform different from that of the drive elements 40 corresponding to the nozzles 15 which are disposed downstream in the conveyance direction, while the drive elements 40 corresponding to the nozzles 15 from which the black ink is discharged have a drive waveform different from that of the drive elements 40 corresponding to the nozzles 15 from which color inks (yellow, cyan, and magenta inks) are discharged, four types of waveform signals are required. Further, when the nozzles 15 from which respective color inks are discharged differ in discharge timing depending on the ink colors, eight types of waveform signals are required.

In the above description, the examples in which the present teaching is applied to the printer which performs print by discharging ink from nozzles are explained. The present teaching, however, is not limited thereto. The present teaching may be applied to any other liquid discharge apparatus than the printer which discharges, from nozzles, any other liquid than the ink.

What is claimed is:

1. A head drive IC, of a liquid discharge head including nozzles and drive elements configured to apply discharge energy to liquid in the nozzles, configured to drive the drive elements, the head drive IC comprising:

a first waveform input part to which a first waveform signal is inputted, the first waveform signal being used for generation of drive signals driving the drive elements;

a second waveform input part to which a second waveform signal is inputted, the second waveform signal being different from the first waveform signal and used for generation of the drive signals;

a switching signal input part to which a switching signal is inputted; and an input switching circuit configured to perform switching between a state in which both of the input of the first waveform signal in the first waveform input part and the input of the second waveform signal in the second waveform input part are allowed, and a state in which the input of the first waveform signal in the first waveform input part is allowed and the input of the second waveform signal in the second waveform input part is blocked, according to an input state of the switching signal in the switching signal input part.

2. The head drive IC according to claim 1, wherein any of a first switching signal and a second switching signal which are different from each other is inputted to the switching signal input part, and the input switching circuit is configured to perform switching such that both of the input of the first waveform signal in the first waveform input part and the input of the second waveform signal in the second waveform input part are allowed in a case of the first switching signal being inputted to the switching signal input part, and that the input of the first waveform signal in the first waveform input part is allowed and the input of the second waveform signal in the second waveform input part is blocked in a case of the second switching signal being inputted to the switching signal input part.

3. The head drive IC according to claim 2, further comprising:

a first drive signal generation circuit including a first drive waveform generation circuit configured to generate, from the first waveform signal, a first drive waveform driving the drive elements and a first multiplexer configured to generate a first drive signal driving first drive elements of the drive elements;

a second drive signal generation circuit including a second drive waveform generation circuit configured to generate, from the second waveform signal, a second drive waveform driving the drive elements and a second multiplexer configured to generate a second drive signal driving second drive elements, of the drive elements, different from the first drive elements; and a waveform switching circuit connected to the first drive waveform generation circuit, the second drive waveform generation circuit, the first multiplexer, and the second multiplexer and configured to switch, according to the switching signal inputted to the switching signal input part, as to which one of the first drive waveform and the second drive waveform is used to generate the second drive signal in the second drive signal generation circuit, wherein the waveform switching circuit is configured to perform switching such that the second drive signal is generated by using the second drive waveform in the second drive signal generation circuit in the case of the first switching signal being inputted to the switching signal input part, and that the second drive signal is generated by using the first drive waveform in the second drive signal generation circuit in the case of the second switching signal being inputted to the switching signal input part.

4. The head drive IC according to claim 3, wherein each of the first drive waveform and the second drive waveform includes a plurality of types of drive wave forms driving the drive elements to discharge different amounts of the liquid respectively from the nozzles.

5. The head drive IC according to claim 3, wherein the first drive waveform includes predetermined liquid-discharge delay time different from that of the second drive waveform.

6. The head drive IC according to claim 2, wherein the input switching circuit includes a switching element configured to switch, according to the switching signal inputted to the switching signal input part, whether the second waveform input part is maintained at a predetermined constant potential, and the switching element is configured to perform switching such that the second waveform signal input part is not maintained at the predetermined constant potential to allow the input of the second waveform signal in the second waveform signal input part in the case of the first switching signal being inputted to the switching signal input part, and that the second waveform signal input part is maintained at the constant potential to block the input of the second waveform signal in the second waveform signal input part in the case of the second switching signal being inputted to the switching signal input part.

7. The head drive IC according to claim 6,
wherein the switching element is a transistor including:
a first connection part connected to the second waveform signal input part;
a second connection part maintained at the predetermined constant potential; and
a third connection part connected to the switching signal input part and disposed between the first connection part and the second connection part,
the transistor configured to:
electrically conduct the first connection part and the second connection part in a case that an electrical potential of the third connection part exceeds a predetermined threshold value which is greater than the predetermined constant potential, and
break the conduction between the first connection part and the second connection part in a case that the electrical potential of the third connection part is not more than the threshold value,
the first switching signal is a signal of the predetermined constant potential, and
the second switching signal is a signal of the electrical potential greater than the threshold value.

8. A liquid discharge apparatus, comprising:
the head drive IC as defined in claim 2,
a liquid discharge head including nozzles and drive elements configured to apply discharge energy to liquid in the nozzles; and
a wiring member connected to the head drive IC,
wherein the wiring member includes:
a first waveform trace connected to the first waveform input part and transmitting the first waveform signal;
a second waveform trace connected to the second waveform input part and transmitting the second waveform signal; and
a first switching trace connected to the switching signal input part and transmitting the first switching signal.

9. A printer, comprising:
the liquid discharge apparatus as defined in claim 8 configured to discharge inks of first color to fourth color as the liquid from the nozzles,
wherein, in a case that both of the inputs of the first waveform signal and the second waveform signal are allowed, the drive IC is set to receive:
a waveform signal to discharge the first and second colors of inks as the first waveform signal; and
a waveform signal to discharge the third and fourth colors of inks as the second waveform signal, and
in a case that the input of the first waveform signal is allowed and the input of the second waveform signal is blocked, the drive IC is set to receive, as the first wave form signal, a waveform signal to discharge the first color of ink and a common waveform signal to discharge the second to fourth colors of inks.

10. The printer according to claim 9,
wherein the first color is black, and
the second to fourth colors are yellow, cyan, and magenta.

11. The printer according to claim 10,
wherein the second color is yellow, and
the third and fourth colors are cyan and magenta.

12. A liquid discharge apparatus, comprising:
the head drive IC as defined in claim 2,
a liquid discharge head including nozzles and drive elements configured to apply discharge energy to liquid in the nozzles; and
a wiring member connected to the head drive IC,
wherein the wiring member includes:
a first waveform trace connected to the first waveform input part and transmitting the first waveform signal and
a second switching trace connected to the switching signal input part and transmitting the second switching signal.

13. A printer, comprising:
the liquid discharge apparatus as defined in claim 12 configured to discharge inks of first color to fourth color as the liquid from the nozzles,
wherein the drive IC is set to receive, as the first wave form signal, a waveform signal to discharge the first color of ink and a common waveform signal to discharge the second to fourth colors of inks.

14. The printer according to claim 13,
wherein the first color is black, and
the second to fourth colors are yellow, cyan, and magenta.

15. The printer according to claim 14,
wherein the second color is yellow, and
the third and fourth colors are cyan and magenta.

* * * * *